US008333620B2

(12) United States Patent
Komatsu

(10) Patent No.: US 8,333,620 B2
(45) Date of Patent: Dec. 18, 2012

(54) TERMINAL MEMBER

(75) Inventor: Seiji Komatsu, Aichi (JP)

(73) Assignee: Tyco Electronics Japan G.K., Kanagawa-Ken (JP)

( * ) Notice: Subject to any disclaimer, the term of this patent is extended or adjusted under 35 U.S.C. 154(b) by 207 days.

(21) Appl. No.: 12/853,887

(22) Filed: Aug. 10, 2010

(65) Prior Publication Data

US 2011/0053436 A1 Mar. 3, 2011

(30) Foreign Application Priority Data

Aug. 28, 2009 (JP) ..... 2009-198015

(51) Int. Cl.
*H01R 9/22* (2006.01)

(52) U.S. Cl. ..... 439/708; 439/213

(58) Field of Classification Search ..... 439/213, 439/709, 790, 792, 907, 708
See application file for complete search history.

(56) References Cited

U.S. PATENT DOCUMENTS

| | | | | | |
|---|---|---|---|---|---|
| 2,549,577 | A * | 4/1951 | Coyle | 439/843 |
| 3,491,328 | A * | 1/1970 | Geis, Jr | 439/513 |
| 4,902,252 | A * | 2/1990 | Whorton et al. | 439/796 |
| 5,044,997 | A * | 9/1991 | Gellenthin, Jr. | 439/835 |
| 5,282,761 | A * | 2/1994 | Hollingsworth | 439/790 |
| 5,462,459 | A * | 10/1995 | Childs | 439/843 |
| 5,505,631 | A * | 4/1996 | Schauer et al. | 439/188 |
| 5,816,851 | A * | 10/1998 | Cheng et al. | 439/510 |
| 7,850,471 | B2 * | 12/2010 | Imai | 439/188 |

FOREIGN PATENT DOCUMENTS

| | | |
|---|---|---|
| JP | 2001-127172 | 5/2001 |
| JP | 2001-313110 | 11/2001 |
| JP | 2006-081373 | 3/2006 |

* cited by examiner

*Primary Examiner* — Thanh Tam Le
(74) *Attorney, Agent, or Firm* — Barley Snyder

(57) ABSTRACT

A terminal member having a plurality of clamp members to electrically connect a plurality set of terminals. Each clamp member includes a pressing member and an insertion body. The terminal member includes a pressing member and an insertion body. The pressing member presses and electrically connects a pair of terminals facing each other. The insertion body presses the pressing member in a direction toward the pair of terminals when the pressing member and the pair of terminals are inserted into the insertion body.

25 Claims, 8 Drawing Sheets

TERMINAL MEMBER

CROSS-REFERENCE TO RELATED APPLICATIONS

This application claims priority under 35 U.S.C. §119 to Japanese Patent Application No. 2009-198015, filed Aug. 28, 2009.

FIELD OF THE INVENTION

The invention relates to a terminal member, and in particular to a terminal member used to connect a motor with a motor driving circuit.

BACKGROUND

Conventionally, each phase of a motor and a control circuit unit for inverter control have been provided separately, each of which are electrically connected using an intermediate harness. However, in recent years, in order to reduce manufacturing time and labor for connecting the intermediate harness, as well as to minimize space, the integration of the motor and the control circuit unit for inverter control has been long studied.

Considering that a high electrical current flows in such a multi-phased motors, Japanese Patent Laid-Open No. 2006-81373 discloses such a design having a bus bar with a large cross-sectional area connecting a terminal connected to each phase of the motor and a terminal on the control circuit unit. In order to achieve high reliability, a bolt has generally been used to connect the terminals to each other either directly or through the intermediate harness.

Also, there has been disclosed a technique in which a metallic clip is used to connect the terminals to each other (for example, refer to Japanese Patent No. 3666354 and Japanese Utility Model Laid-Open No. 01-127172).

The connection of terminals to each other is required to achieve high reliability. In Japanese Patent Laid-Open No. 2006-81373, the terminals are connected firmly to each other using a bolt. However, the number of bolts corresponding to the number of motor phases, generally, three phases. Therefore, to connect the terminals to each other, a large number of bolts must be tightened, which increases the amount time and labor in manufacturing.

On the other hand, Japanese Patent No. 3666354 and Japanese Utility Model Laid-Open No. 01-127172, disclose a method in which the crimping force (contact load) between the terminals is increased by a clip. In this design, to increase the crimping force of terminals, the elastic force of clip should be increased. However, the increase in elastic force of clip increases insertion resistance of the terminal at the time of connection, which poses a problem of difficulty in connecting the motor and the control circuit unit to each other. Further, also in the case of the clip, similar time and labor are required to mount the clips to the number of terminals corresponding to the number of motor phases.

SUMMARY

The invention, in view of the above problems, provides a terminal member capable of connecting a motor and a motor control circuit unit to each other reliably and efficiently.

The terminal member includes a pressing member and an insertion body. The pressing member presses and electrically connects a pair of terminals facing each other. The insertion body presses the pressing member in a direction toward the pair of terminals when the pressing member and the terminals are inserted into the insertion body.

BRIEF DESCRIPTION OF THE DRAWINGS

The invention will be explained in greater detail below with reference to Figures and exemplary embodiments, without the general concept of the invention being limited.

DETAILED DESCRIPTION OF THE EMBODIMENT(S)

An embodiment of the invention will now be described in detail with reference to the accompanying drawings.

Figure 1:
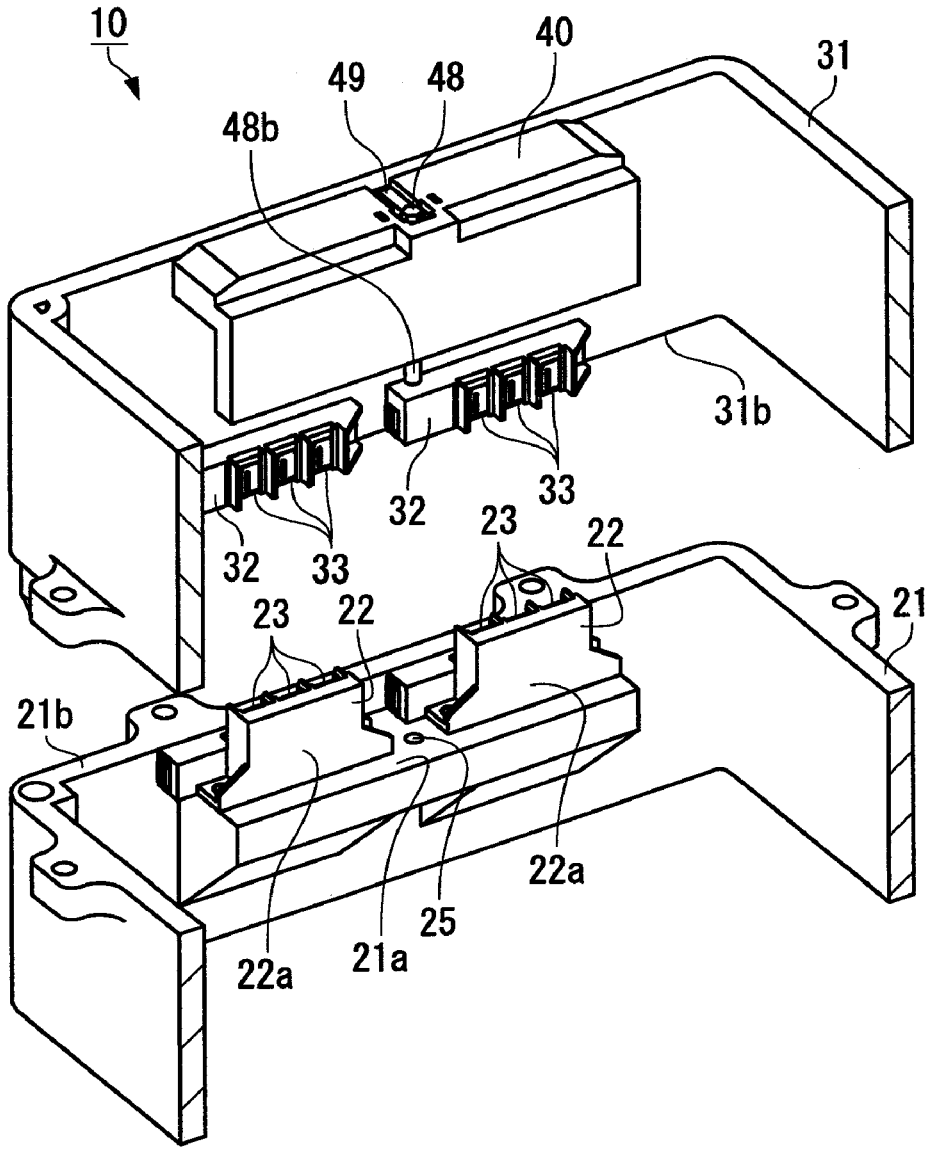
FIG. 1 is a perspective view of a terminal member according to the invention.

FIG. 1 is an explanatory view for explaining the configuration of a terminal member 10 according to the invention, for connecting a motor and an inverter control circuit to each other.

As shown in FIG. 1, on a motor side, a motor-side terminal block 21 is integrally provided in a housing of a motor. The motor-side terminal block 21 includes a block 21*a*, with a terminal holding member 22 being provided on the block 21*a*. The terminal holding member 22 includes a support wall 22*a* extending to the side facing an inverter control circuit (hereinafter, this side is referred to as the upside). The terminal holding member 22 includes a predetermined number of terminals 23 (i.e. bus bars) for supplying a current to each phase of the motor.

Figure 2A:
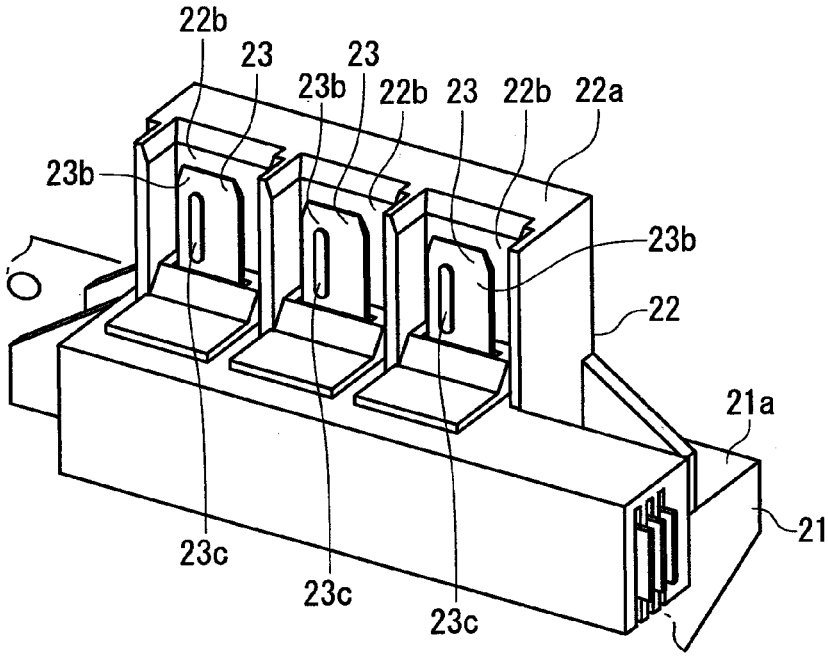
FIG. 2A is a perspective view of a terminal holding member of the terminal member on a motor side.
Figure 3:
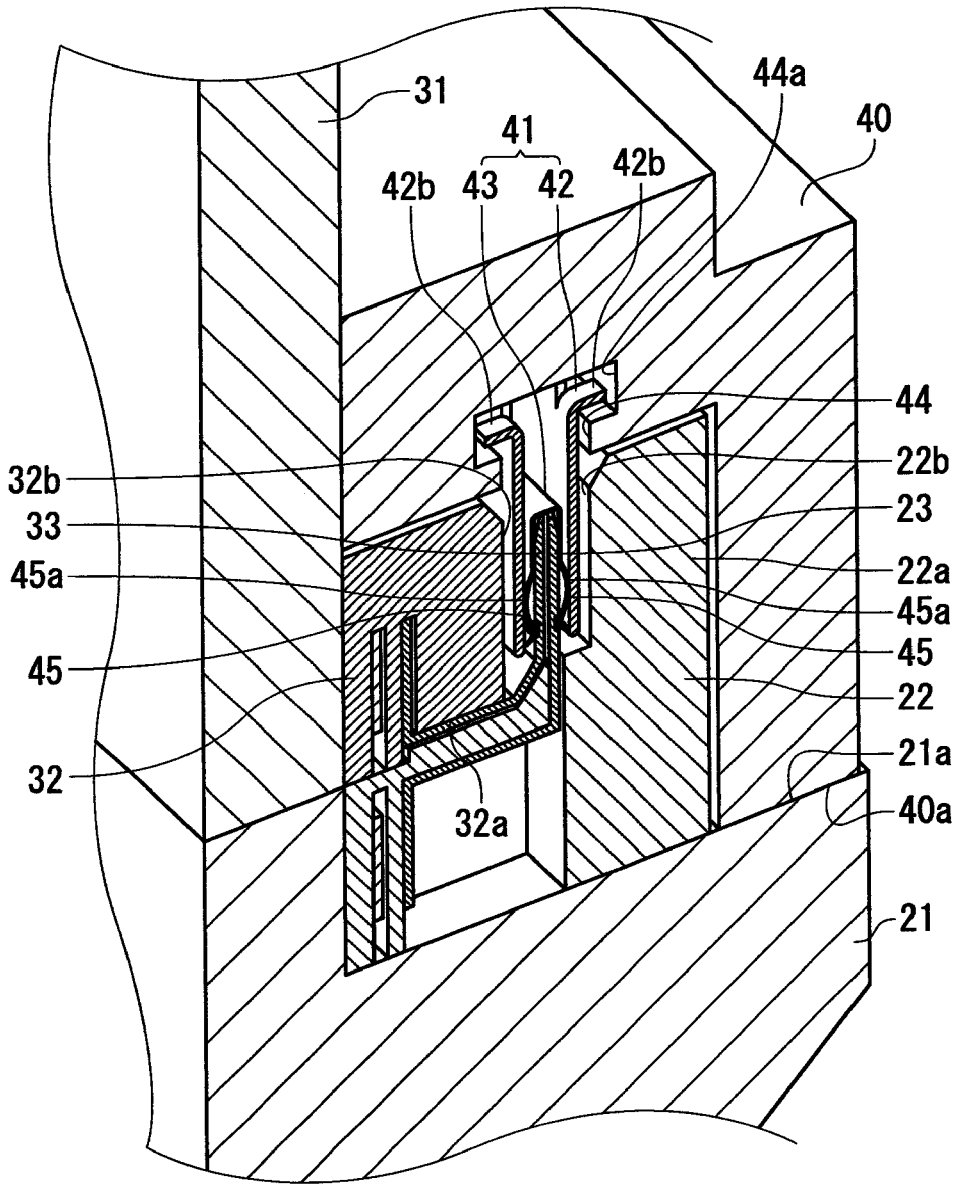
FIG. 3 is a sectional perspective view of a state in which a terminal on the motor side and a terminal on the inverter side are clamped to each other by a clamp member.

As shown in FIGS. 2A and 3, each of the terminals 23 is a so-called bus bar that is fabricated by bending a strip-shaped rigid metallic plate having a fixed thickness into a predetermined shape. The terminal 23 is configured so that one end side thereof (not shown) penetrates the terminal holding member 22 to be connected to each phase of the motor, and one surface of the other end side thereof faces the support wall 22*a* with a gap being provided therebetween, and the other surface 23*b* thereof is exposed. Also, the other surface 23*b* of the terminal 23 includes, for example, a ridge 23*c* that is continuous in the extending direction of the terminal 23. The continuity direction, shape, and the like of the ridge 23*c* are not subject to any special restriction.

As shown in FIG. 1, on the inverter control circuit side, an inverter-side terminal block 31 is integrally provided in a housing of an inverter control circuit. On the inverter-side terminal block 31, a terminal holding member 32 is provided.

Figure 2B:
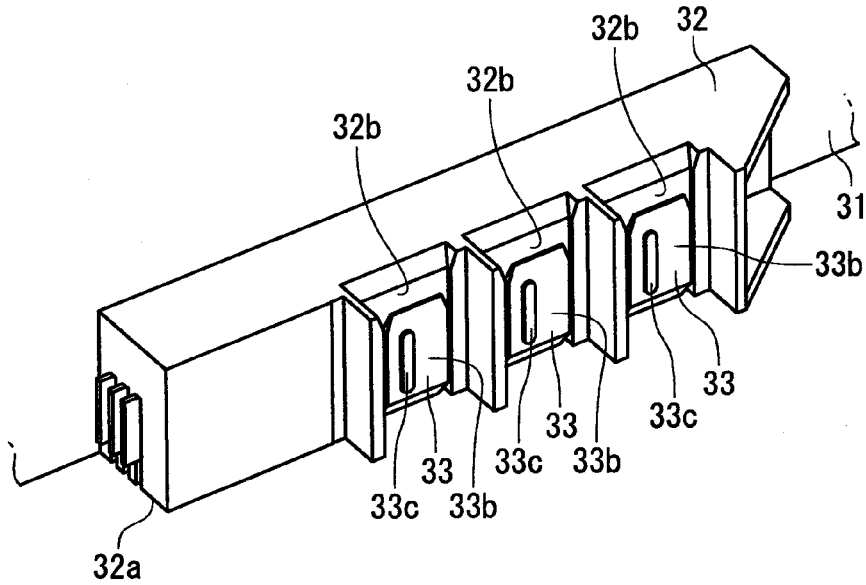
FIG. 2B is a perspective view of a terminal holding member of the terminal member on an inverter side.

As shown in FIG. 2B, the terminal holding member 32 includes a plurality of terminals 33 (i.e. bus bars) for supplying a current from the inverter control circuit to each phase of the motor so as for the terminals 33 to correspond to the terminals 23 of the motor-side terminal block 21. The terminal holding member 32 includes a planar part 32*a* on the side facing the motor-side terminal block 21 (downside).

Each of the terminals 33 is a so-called bus bar that is fabricated by bending a strip-shaped rigid metallic plate having a fixed thickness into a predetermined shape. The terminal 33 is configured so that one end side thereof (not shown) penetrates the terminal holding member 32 to be connected to each phase of the inverter control circuit, and one surface of the other end side thereof faces a side wall 32*b* of the terminal holding member 32 with a gap being provided therebetween, and the other surface 33*b* thereof is exposed. Also, the other surface 33*b* of the terminal 33 includes, for example, a ridge 33*c* that is continuous in the extending direction of the terminal 33. The continuity direction, shape, and the like of the ridge 33*c* are not subject to any special restriction.

When a top surface 21*b* of the motor-side terminal block 21 and a bottom surface 31*b* of the inverter-side terminal block 31 press against each other, the other surface 23*b* of the terminal 23 faces the other surface 33*b* of the terminal 33, and the ridges 23*c* and 33*c* come into contact with each other.

As shown in FIG. 1, the inverter-side terminal block 31 includes a terminal holder 40 for clamping the motor-side terminals 23 and the inverter-side terminals 33 to each other to electrically connect these terminals.

As shown in FIG. 4, the terminal holder 40 includes, on the bottom surface thereof, clamp members 41 for clamping the terminals 23 and 33 facing each other as described above. The number of clamp members 41 corresponds to the number of sets of terminals 23.

Each of the clamp members 41 includes an insertion body 42 (i.e. sleeve) and a pressing member 43 (i.e. clamp fitting).

As shown in FIGS. 3 to 5B, the insertion body 42 is of a tubular shape, and in the upper end part thereof, protrusions 42*b* projecting to the outer periphery side are provided. The insertion body 42 is provided in a recess 44 formed in the terminal holder 40 so as to be movable along the axis direction of the insertion body 42. The recess 44 includes an expanded section 44*a*, and the protrusions 42*b* of the insertion body 42 can move in the expanded section 44*a*. Therefore, the insertion body 42 is held so as not to come off the recess 44.

Figure 5B:
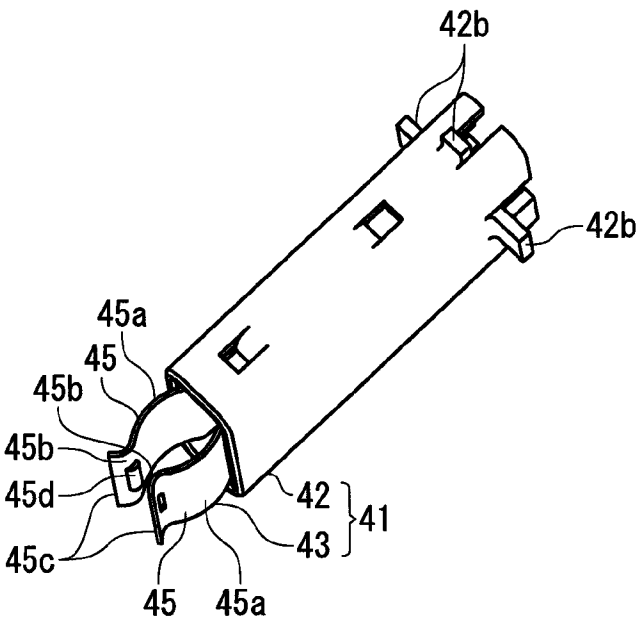
FIG. 5B is a perspective view of the clamp inserted into the sleeve.
Figure 5A:
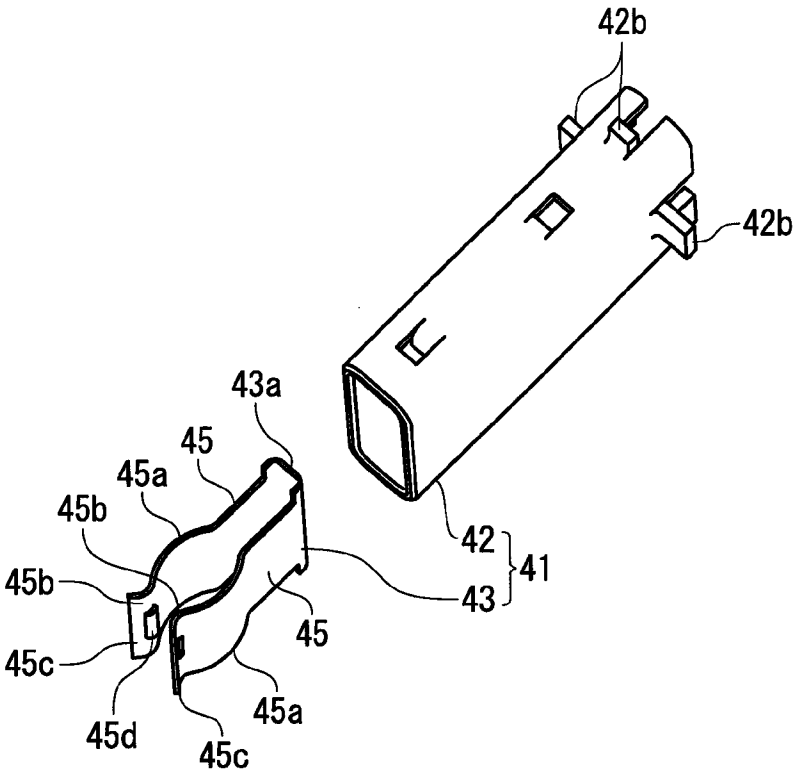
FIG. 5A is a perspective view a sleeve and a clamp fitting of the clamp member according to the invention.

As shown in FIGS. 3 and 5A the pressing member 43 has a forked shape in which a pair of two arms 45 branch off from a base end 43*a* and extend. Each of the arms 45 has a curved part (i.e. projection) expanding to the outside in an intermediate part, a contact part 45*b* expanding to the inside for contacting with the terminal 23, 33, and a distal end 45*c* warped to the outside. The contact part 45*b* is located closer to the distal end of the arms 45 than the curved part 45*a*.

Figure 6:
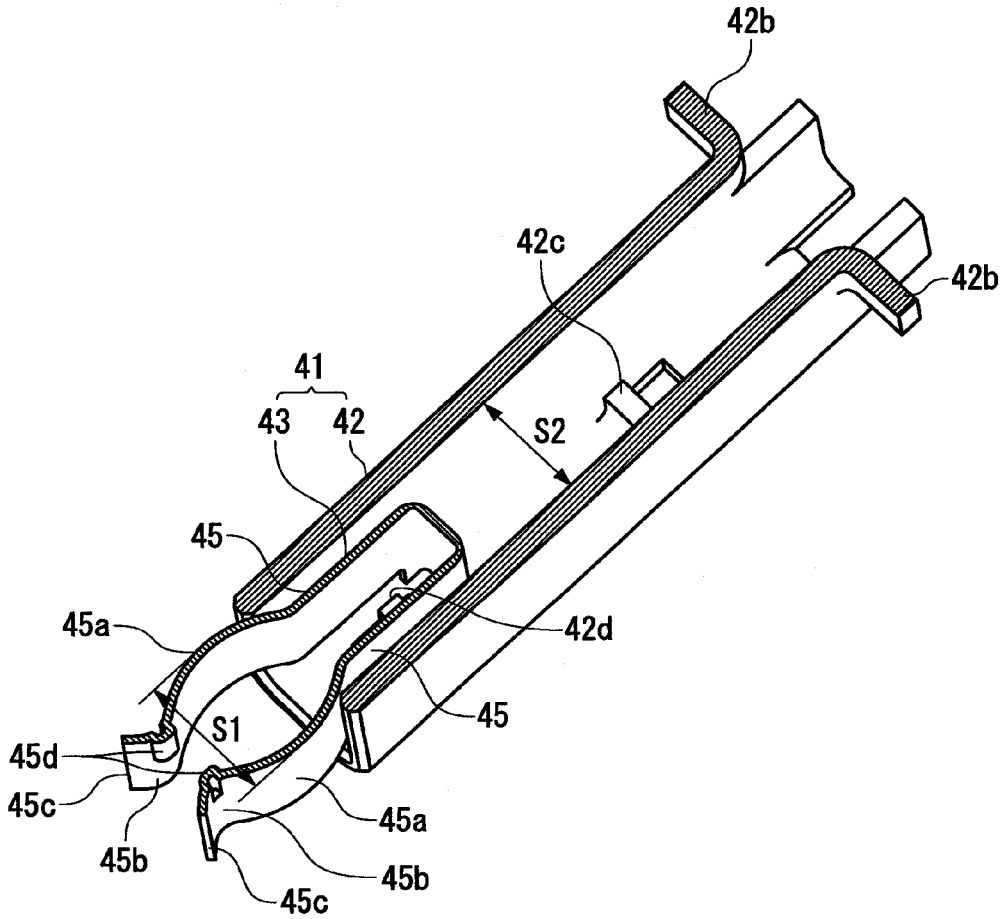
FIG. 6 is a sectional perspective view of the clamp member.

The pressing member 43 can slide along the inside space of the insertion body 42 so that the curved parts 45*a* can go into and out of the insertion body 42. As shown in FIG. 6, on the inner peripheral surface of the insertion body 42, protrusions 42*c* and 42*d* are formed so that the movement stroke of the pressing member 43 in the insertion body 42 is restricted by the hitting of the base end 43*a* of the pressing member 43 against the protrusions 42*c* and 42*d*. The outside dimension S1 of the curved parts 45*a* of the pressing member 43 is set larger than the inside dimension S2 of the insertion body 42. Therefore, when the curved parts 45*a* are exposed, outside of the insertion body 42, there are no forces on the pressing member 43 such that the arms 45 are forced closed by the insertion body 42. As a result, the arms 45 of the pressing body 43 bias open. As shown in FIG. 5B, when the pressing member 43 is pushed into the insertion body 42, the curved parts 45*a* come into contact with the inner peripheral surface of the insertion body 42, so that the arms 45 are closed.

Figure 4A:
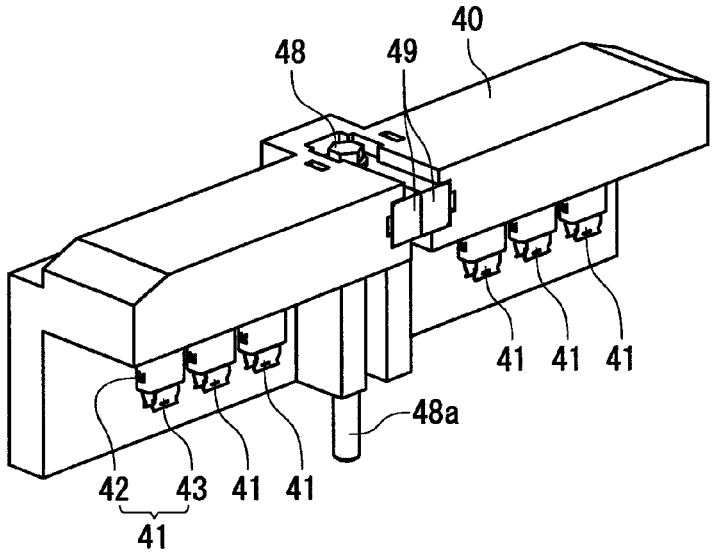
FIG. 4A is a perspective view of a terminal holder according to the invention.
Figure 4B:
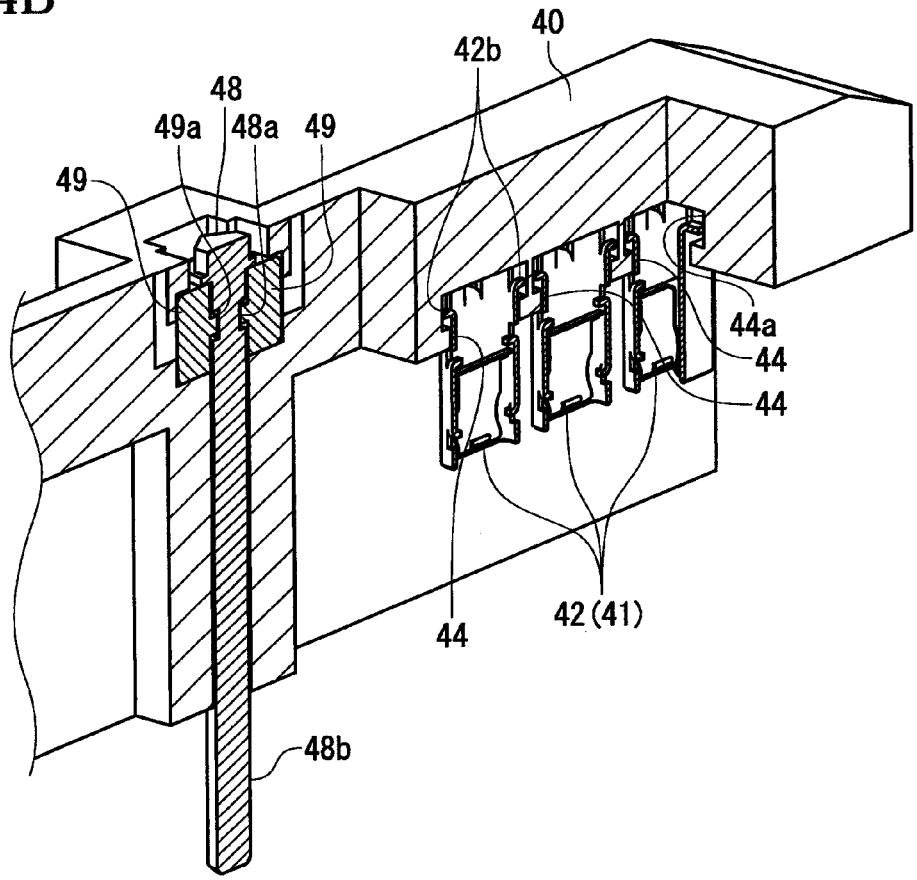
FIG. 4B is a sectional perspective view showing sleeves and a connecting bolt provided in the terminal holder.

As shown in FIGS. 4A and 4B, the terminal holder 40 includes a connecting bolt 48 in the central part thereof. The connecting bolt 48 is held in the terminal holder 40 so as to be turnable around the axis thereof using a holding sleeve 49. On the outer peripheral surface of the connecting bolt 48 and the inner peripheral surface of the holding sleeve 49, step sections 48*a* and 49*a* engaging with each other, respectively, are formed so as to be continuous in the circumferential direction. Thereby, the connecting bolt 48 is restrained from moving in the axis direction with respect to the inverter-side terminal block 31.

A distal end 48*b* of the connecting bolt 48 has threads, and the threads can be screwed into a threaded hole 25 formed in the block 21*a* of the motor-side terminal block 21. When the distal end 48*b* of the connecting bolt 48 is screwed into the threaded hole 25 while the motor-side terminal block 21 and the inverter-side terminal block 31 are pressed against each other, the motor-side terminal block 21 and the terminal holder 40 are brought close to each other by the tightening force of the connecting bolt 48. Finally, as shown in FIG. 3, a bottom surface 40*a* of the terminal holder 40 hits the block 21*a* of the motor-side terminal block 21.

Also, when the connecting bolt 48 is loosened, the terminal holder 40 moves away from the terminal holding member 22 of the motor-side terminal block 21.

In order to electrically connect the motor and the inverter to each other by using the terminal member 10 having the motor-side terminal block 21, the inverter-side terminal block 31, and the terminal holder 40 configured as described above, the procedure described below is carried out.

Figure 7A:
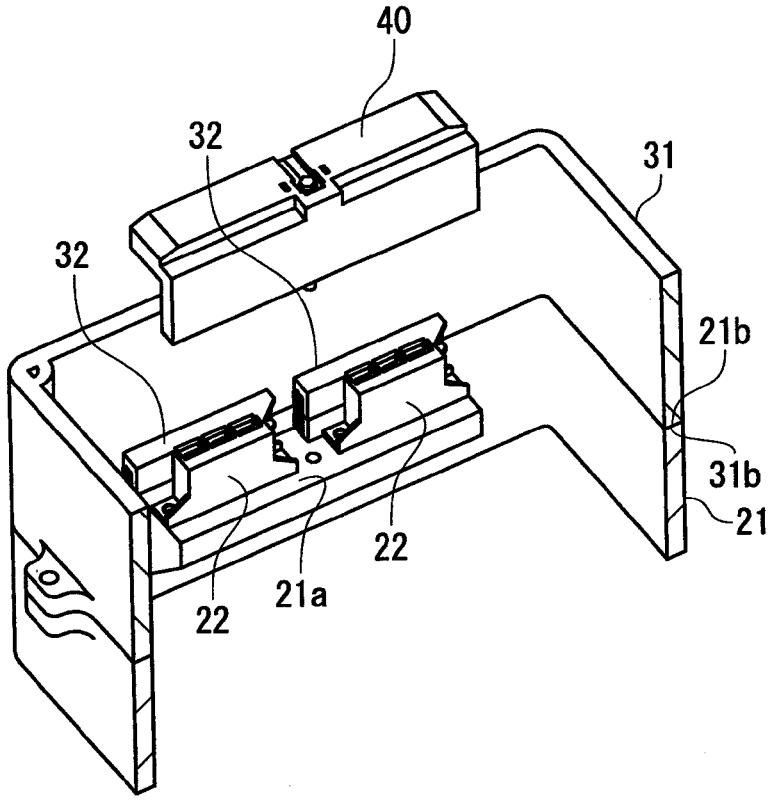
FIG. 7A is a perspective view showing a state in which a motor-side terminal block and an inverter-side terminal block abut each other.
Figure 8A:
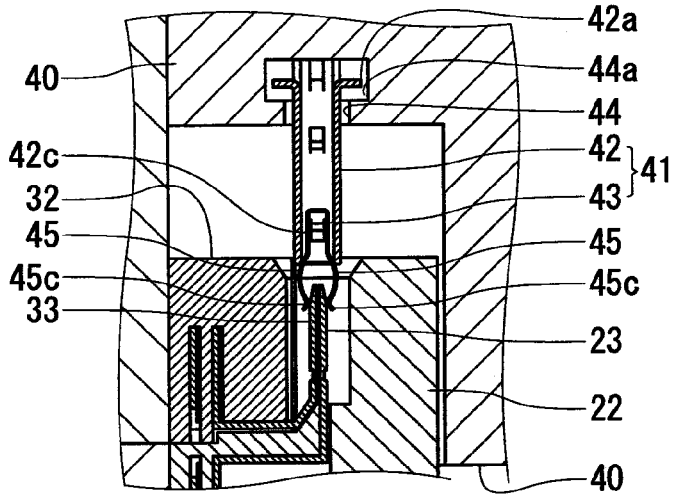
FIG. 8A is a sectional view of the terminal member where a distal end of a clamp fitting is positioned next to adjacent terminals.

First, as shown in FIG. 7A, the top surface 21*b* of the motor-side terminal block 21 and the bottom surface 31*b* of the inverter-side terminal block 31 are pressed against each other. Then, as shown in FIG. 8A, the terminal 23 held by the terminal holding member 22 and the terminal 33 held by the terminal holding member 32 face each other.

When the connecting bolt 48 is screwed into the threaded hole 25, the motor-side terminal block 21 and the terminal holder 40 are brought close to each other by the tightening force of the connecting bolt 48.

At this time, in each of the clamp members 41 provided on the terminal holder 40, the pressing member 43 is pulled out of the insertion body 42 and the arms 45 are open, and the distal ends of the terminals 23 and 33 facing each other go in between the distal ends 45*c* of the arms 45. At this time, the arms 45 of the pressing member 43 are open and the distal ends of the distal ends 45*c* warp to the outside. Therefore, the distal ends of the terminals 23 and 33 easily go in between the arms 45.

Figure 8B:
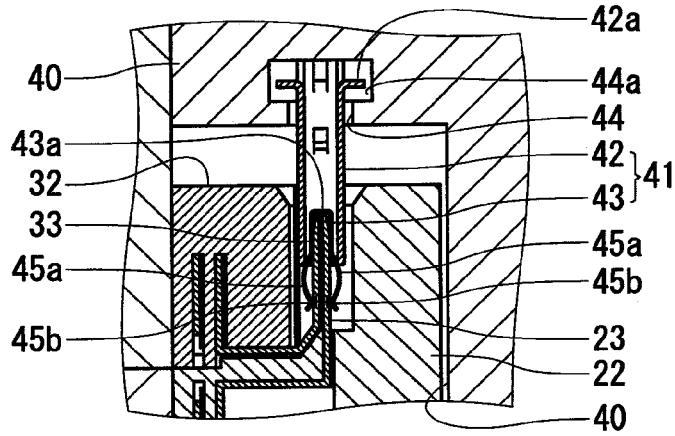
FIG. 8B is a sectional view of the terminal member wherein the terminal is inserted into a base end of the clamp fitting.

When the connecting bolt 48 is tightened further and the terminal holder 40 is urged toward to the motor-side terminal block 21, as shown in FIG. 8B, the pressed terminals 23 and 33 go in between the arms 45 of the pressing member 43. When the curved parts 45*a* come into contact with the inner peripheral surface of the insertion body 42 in this state, the arms 45 begin to be closed, and the terminals 23 and 33 are held by the pressing member 43.

When the connecting bolt 48 is tightened further, the terminals 23 and 33 hit the base end 43*a* of the pressing member 43. Thereafter, as the terminal holder 40 comes close to the motor-side terminal block 21, the terminals 23 and 33 push the pressing member 43 into the insertion body 42.

When the pressing member 43 is pushed into the insertion body 42, the curved parts 45*a* come into contact with the inner peripheral surface of the insertion body 42, so that the arms 45 press the terminals 23 and 33.

Figure 7B:
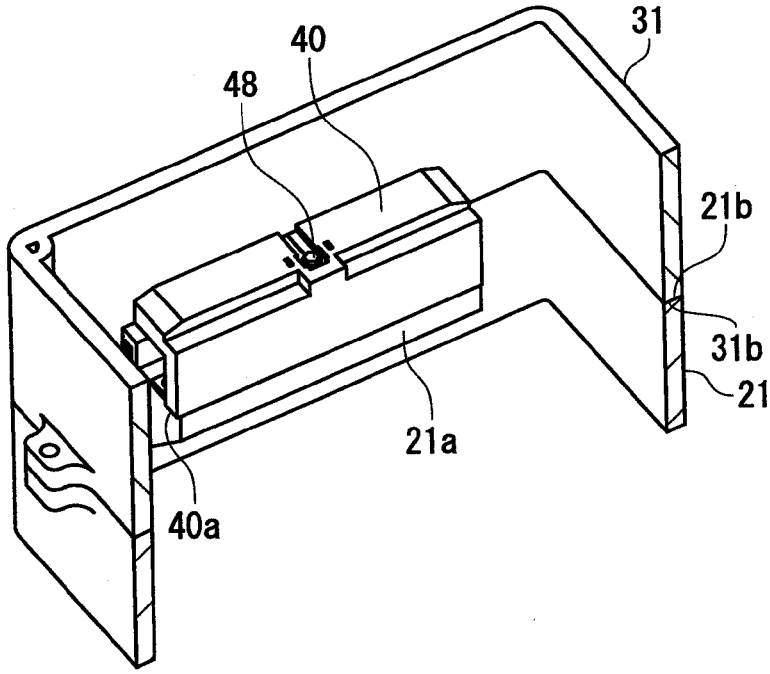
FIG. 7B is a perspective view showing a state in which a motor-side terminal and an inverter-side terminal are connected to each other by the terminal holder according to the invention.
Figure 8C:
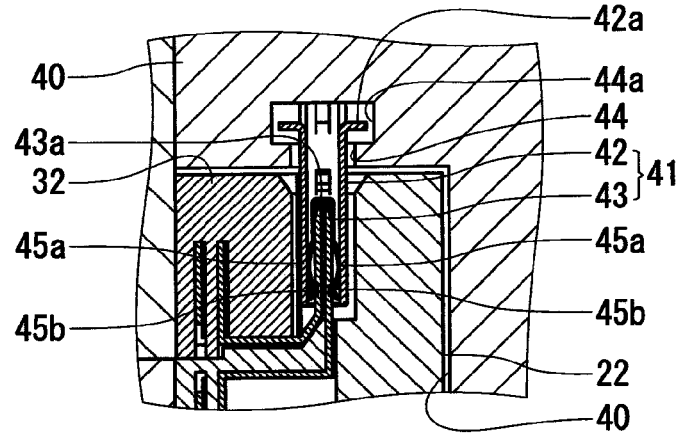
FIG. 8C is a sectional view of the terminal where the clamp fitting is inserted into the sleeve to connect the terminals.

As shown in FIG. 7B, when the connecting bolt 48 is tightened until the bottom surface 40*a* of the terminal holder 40 hits the block 21*a* of the motor-side terminal block 21, the pressing member 43 is further pushed into the insertion body 42. As shown in FIG. 8C, when the curved parts 45*a* go in the insertion body 42 completely, the contact load applied to the terminals 23 and 33 in the contact parts 45*b* of the arms 45 becomes at a maximum. Thereby, the ridges 23*c* and 33*c* of the terminals 23 and 33 come into close contact with each other, and the terminals 23 and 33 are electrically connected to each other directly.

When the connecting bolt 48 is loosened from this state, the terminal holder 40 moves away from the motor-side terminal block 21. Then, the pressing member 43 slips out from the insertion body 42 gradually, and finally, as shown in FIGS. 8B and 8A, the curved parts 45*a* of the arms 45 are exposed to the outside from the insertion body 42. In this state, the arms 45 are open and return to a free state. Therefore, the terminals 23 and 33 can be removed easily from the pressing member 43. At this time, if protrusions 45*d* are provided in advance in the contact parts 45*b* of the arms 45, the protrusions 45*d* are caught by the ridges 23*c* and 33*c* when the terminal holder 40 moves away from the motor-side terminal block 21. Thereby the insertion body 42 is pulled up while the pressing member 43 remains on the terminals 23 and 33. Therefore, the pressing member 43 is pulled out of the insertion body 42, the arms 45 being opened, so that the pressing member 43 can be removed easily from the terminals 23 and 33.

As described above, by providing the plurality of clamp members 41 on the terminal holder 40, merely by pushing the terminal holder 40 in, the plurality of sets of terminals 23 and 33 can be clamped by the clamp members 41 and can be electrically connected to each other efficiently.

Moreover, since the terminal holder 40 can be moved easily by using the connecting bolt 48, the terminals 23 and 33 can be connected to each other easily and reliably also in this respect.

Also, in the clamp member 41, the pressing member 43 is closed and opened by causing the curved parts 45*a* to go into and out of the insertion body 42. Thus, when the terminals 23 and 33 are inserted into the pressing member 43, the pressing member 43 is open, and therefore the terminals 23 and 33 can be inserted easily.

Thereafter, as the terminal holder 40 is pushed in, the pressing member 43 is closed by the insertion body 42, so that the contact load applied to the terminals 23 and 33 can be increased. Therefore, the terminals 23 and 33 of each phase can be electrically connected to each other reliably without the occurrence of large variations in contact load. Since the spring steel forming the pressing member 43 has high conductor resistance, the terminals 23 and 33 can be electrically connected to each other efficiently by electrically connecting the terminals 23 and 33 to each other directly.

According to the invention, merely by inserting the pressing member 40 and the terminals 23 and 33 into the insertion body 42, the pressing member 43 is pressed in the direction such as to move proximate to the terminals 23 and 33, whereby the terminals 23 and 33 can be electrically connected to each other. Therefore, the motor and the motor control circuit unit can be connected to each other reliably and efficiently.

In the above-described embodiment, the configurations of the motor-side terminal block 21 and the inverter-side terminal block 31 have been described. However, the specific shapes and configurations thereof may be any other ones as far as falling within the spirit and scope of the invention.

Also, the motor to which the invention can be applied is not limited to the motor in accordance with this embodiment, but may be a motor for any other application.

Besides, the configurations described in the above-described embodiment can be selected or changed to other configurations as appropriate without departing from the spirit and scope of the invention.

What is claimed is:

1. A terminal member comprising:

a pressing member pressing and electrically connecting a pair of terminals with a surface of one terminal directly contacting with a surface of the other terminal; and an insertion body pressing the pressing member in a direction toward the pair of terminals when the pressing member and the pair of terminals are inserted into the insertion body.

2. The terminal member according to claim 1, wherein the insertion body is a sleeve having a tubular shape.

3. The terminal member according to claim 2, wherein the sleeve includes a protrusion projecting toward an outer periphery side at one end of the insertion body.

4. The terminal member according to claim 1, wherein the pressing member is an elastic deformable clamp fitting.

5. The terminal member according to claim 1, wherein the pressing member includes a pair of curved parts biased away from the pair of terminals when positioned along the pair of terminals.

6. The terminal member according to claim 5, wherein each curved part comes into contact with an inner peripheral surface of the insertion body and elastically deforms in a direction toward the pair of terminals.

7. The terminal member according to claim 1, wherein the pressing member includes a pair of arms extending along both sides of the pair of terminals, and the pair of terminals are secured between the pair of arms.

8. The terminal member according to claim 1, wherein the pressing member includes a base end and a pair of arms that extend from the base end.

9. The terminal member according to claim 8, wherein each of the pair of arms includes a curved part expanding to the outside of the arm.

10. The terminal member according to claim 9, wherein each of the pair of arms includes a contact part for contacting with one of the pair of terminals and a distal end bent to an outside of the arm.

11. The terminal member according to claim 10, wherein the contact part is located closer to the distal end than the curved part.

12. The terminal member according to claim 11, wherein an outside dimension of pair of curved parts is larger than an inside dimension of the insertion body.

13. The terminal member according to claim 1, wherein the insertion body includes a protrusion for preventing the pressing member from being completed removed from the insertion body.

14. The terminal member according to claim 13, wherein the insertion body includes at least two protrusions with one of the at least two protrusions positioned on the inner peripheral surface of the insertion body.

15. A terminal member comprising:

a pressing member pressing and electrically connecting a pair of terminals facing each other, including a base end and a pair of arms that extend from the base end; and an insertion body pressing the pressing member in a direction toward the pair of terminals when the pressing member and the pair of terminals are inserted into the insertion body, wherein each of the pair of arms includes a curved part expending to the outside of the arm, wherein an outside dimension of pair of curved parts is larger than in inside dimension of the insertion body.

16. The terminal member according to claim 15, wherein the insertion body is a sleeve having a tubular shape.

17. The terminal member according to claim 16, wherein the sleeve includes a protrusion projecting toward an outer periphery side at one end of the insertion body.

18. The terminal member according to claim 15, wherein the pressing member is an elastic deformable clamp fitting.

19. The terminal member according to claim 15, wherein the pressing member includes a pair of curved parts biased away from the pair of terminals when positioned along the pair of terminals.

20. The terminal member according to claim 19, wherein each curved part comes into contact with an inner peripheral surface of the insertion body and elastically deforms in a direction toward the pair of terminals.

21. The terminal member according to claim 15, wherein the pressing member includes a pair of arms extending along both sides of the pair of terminals, and the pair of terminals are secured between the pair of arms.

22. The terminal member according to claim 15, wherein each of the pair of arms includes a contact part for contacting with one of the pair of terminals and a distal end bent to an outside of the arm.

23. The terminal member according to claim 22, wherein the contact part is located closer to the distal end than the curved part.

24. The terminal member according to claim 15, wherein the insertion body includes a protrusion for preventing the pressing member from being completed removed from the insertion body.

25. The terminal member according to claim 24, wherein the insertion body includes at least two protrusions with one of the at least two protrusions positioned on the inner peripheral surface of the insertion body.

* * * * *